US012768259B2

(12) United States Patent
Mantle et al.

(10) Patent No.: US 12,768,259 B2
(45) Date of Patent: Oct. 20, 2026

(54) AUTOMATED CONTROL OF TRAJECTORY OF DOWNHOLE DRILLING

(71) Applicant: Schlumberger Technology Corporation, Sugar Land, TX (US)

(72) Inventors: Katharine Mantle, Cheltenham (GB); Maja Ignova, Cheltenham (GB); Ekaterina Brovko, Cheltenham (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 296 days.

(21) Appl. No.: 18/632,452

(22) Filed: Apr. 11, 2024

(65) Prior Publication Data

US 2024/0352844 A1 Oct. 24, 2024

Related U.S. Application Data

(60) Provisional application No. 63/497,824, filed on Apr. 24, 2023.

(51) Int. Cl.
*E21B 44/00* (2006.01)
*E21B 7/04* (2006.01)

(52) U.S. Cl.
CPC ..... *E21B 44/00* (2013.01); *E21B 7/04* (2013.01)

(58) Field of Classification Search
CPC . E21B 44/00; E21B 7/04; E21B 7/067; E21B 47/024
See application file for complete search history.

(56) References Cited

U.S. PATENT DOCUMENTS

| | | | | |
|---|---|---|---|---|
| 9,273,547 | B2 * | 3/2016 | Brooks | E21B 47/022 |
| 9,982,525 | B2 | 5/2018 | Brooks et al. | |
| 10,166,082 | B1 * | 1/2019 | Hariri | A61B 34/71 |
| 2008/0161999 | A1 * | 7/2008 | Davis | B62D 12/00 180/443 |
| 2013/0199844 | A1 * | 8/2013 | Bayliss | E21B 44/00 175/45 |
| 2014/0283773 | A1 * | 9/2014 | Elfers | F01L 1/3442 123/90.17 |
| 2015/0211351 | A1 | 7/2015 | Bayliss et al. | |
| 2015/0218887 | A1 | 8/2015 | Bayliss et al. | |
| 2017/0343483 | A1 * | 11/2017 | Piana | B65G 17/26 |
| 2021/0270088 | A1 * | 9/2021 | Hornblower | E21B 45/00 |
| 2023/0038752 | A1 * | 2/2023 | Hamzah | E21B 47/26 |

FOREIGN PATENT DOCUMENTS

| | | | | |
|---|---|---|---|---|
| AU | 2014295534 | A1 * | 2/2016 | H03K 17/166 |

* cited by examiner

*Primary Examiner* — Redhwan K Mawari
(74) *Attorney, Agent, or Firm* — Jeffrey D. Frantz

(57) ABSTRACT

Methods and systems are provided for automated control of drilling trajectory during directional drilling of a build section or curve or bend of a wellbore.

20 Claims, 6 Drawing Sheets

AUTOMATED CONTROL OF TRAJECTORY OF DOWNHOLE DRILLING

CROSS-REFERENCE TO RELATED APPLICATION(S)

The present disclosure claims priority from U.S. Provisional Appl. No. 63/497,824, filed on Apr. 24, 2023, entitled "AUTOMATED CONTROL OF TRAJECTORY OF DOWNHOLE DRILLING", herein incorporated by reference in its entirety.

FIELD

Disclosed embodiments relate generally to automated methods and systems for directional control during downhole directional drilling operations.

BACKGROUND

Directional drilling can be used to control the trajectory of the wellbore such that it deviates from vertical. For example, directional drilling is commonly used to drill S-type wells, slant wells, and horizontal wells. These wellbores include one or more build sections or curves or bends where the trajectory follows a generally curved path.

Directional drilling systems can employ a rotary steerable system (RSS) to control the trajectory of the wellbore being drilled. The RSS uses a downhole steering mechanism that is controlled by a drilling operator who transmits commands to the downhole steering mechanism using surface equipment, to which the steering mechanism responds to steer the drilling in a desired direction. The steering mechanism employed by the RSS generally fall into two broad categories, these being "push-the-bit" or "point-the-bit". Push-the-bit steering mechanisms generally use pads on the outside of the tool which press against the wellbore thereby causing a direction change. Point-the-bit steering mechanisms cause the direction of the drill bit to change relative to the rest of the tool by bending the main shaft running through it. The point-the-bit steering mechanisms typically employ some kind of non-rotating housing or reference housing in order to create this deflection within the shaft.

In current drilling practices, the trajectory of the build section(s) of a wellbore is controlled by automated drilling methods that use target inclination and target azimuth of the wellbore being drilled together with measurements of both inclination and azimuth of the actual trajectory of the wellbore being drilled in closed loop control of the RSS of the drilling system. The measurements of inclination and azimuth of the actual trajectory of the wellbore can be derived from downhole sensors, such as accelerometers, magnetometers, and gyroscopes.

In some instances, noise in the azimuth measurements used in the closed loop control of the RSS while drilling the build section can be high, and this noise can affect performance. For example, jumpy or erratic azimuth measurements used in such closed loop control can result in an erratic toolface (i.e., direction of drilling) or an erratic SR parameter (i.e., time that the steering mechanism will spend in holding the desired toolface), which can result in less efficient drilling, a less smooth well path and in some cases lead the drilling operation to believe that the closed loop control of the RSS is not working.

Furthermore, the closed loop control of the RSS while drilling the build section generally uses a large number of downlinks to the RSS that communicate gravity toolface (GTF) data representing the variable target direction in the build section of the wellbore. The GTF data represents the angular deviation about the circumference of some component of the downhole tool with respect to the highside (HS) of the tool collar (or borehole). These large number of GTF downlinks can limit the rate of penetration of the drilling and also lead to human errors.

SUMMARY

In an embodiment, methods and systems are provided for automated control of the trajectory of a build section or bend or curve of a wellbore that is drilled by a drilling system that employs a rotary steerable system (RSS). Target inclination and target azimuth of the RSS are determined for the build section or bend or curve while drilling. The target inclination together with measurements of inclination of the wellbore being drilled are used in closed loop control of the inclination of the RSS. Concurrently with the closed loop inclination control, the target azimuth is used for open loop control of the azimuth of the RSS. The target inclination and target azimuth of the RSS can be determined from toolface parameters, such as parameters specifying gravity toolface (GTF) or magnetic toolface (MTF) downlinked to the RSS.

In an embodiment, methods and systems are provided for automated control of the trajectory of a build section or bend or curve of a wellbore that is drilled by a drilling system that employs an RSS. The RSS is configured to receive toolface parameters representing MTF for drilling a build section or curve or bend of a wellbore. The MTF parameters are used to determine a target inclination and target azimuth of the wellbore while drilling. The target inclination and the target azimuth are used together with measurements of azimuth and inclination of the wellbore being drilled in closed loop control of the azimuth and inclination of the RSS of the drilling system while drilling the build section or bend or curve of the wellbore.

In embodiments, the control modes as described herein can be repeated with stepwise adjustments to toolface parameters over time during drilling. Such stepwise adjustments can represent the variable target direction in the build section or curve of bend in the wellbore such that the trajectory of the drilling and the resulting wellbore follows or approximates a planned or otherwise desired curved path.

The disclosed embodiments may provide various technical advantages. For example, the disclosed embodiments provide for real-time closed loop control of the drilling toolface. As such, the disclosed methods can improve drilling efficiency.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

The subject disclosure is further described in the detailed description which follows, in reference to the noted plurality of drawings by way of non-limiting examples of the subject disclosure, in which like reference numerals represent similar parts throughout the several views of the drawings, and wherein.

DETAILED DESCRIPTION

The particulars shown herein are by way of example and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details in more detail than is necessary for the fundamental understanding of the subject disclosure, the description taken with the drawings making apparent to those skilled in the art how the several forms of the subject disclosure may be embodied in practice. Furthermore, like reference numbers and designations in the various drawings indicate like elements.

Figure 1:
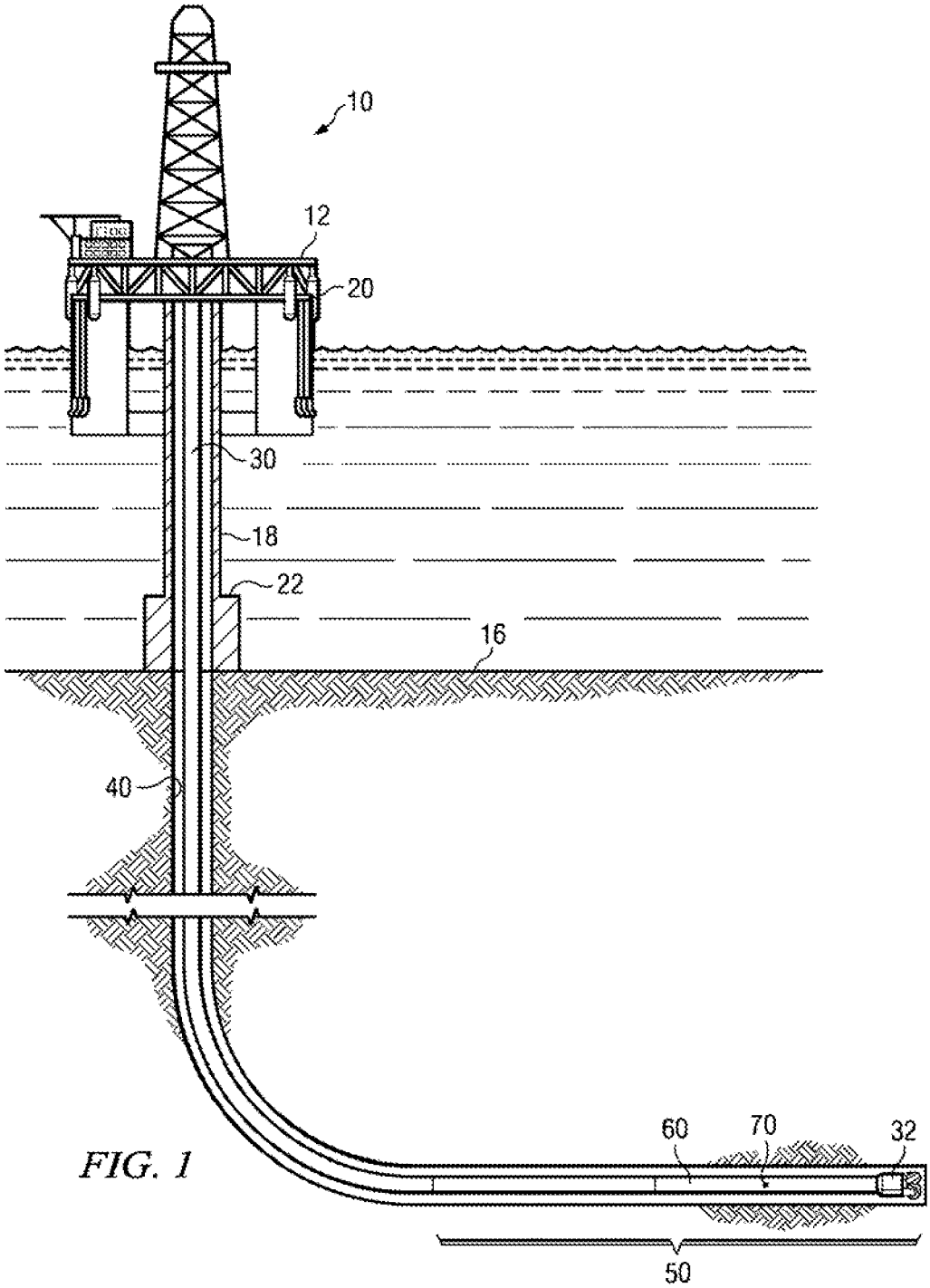
FIG. 1 depicts an example drilling rig on which disclosed embodiments may be utilized.

FIG. 1 depicts a drilling rig 10 suitable for using various method and system embodiments disclosed herein. Semi-submersible drilling platform 12 is positioned over an oil or gas formation (not shown) disposed below sea floor 16. Subsea conduit 18 extends from deck 20 of platform 12 to a wellhead installation 22. The platform may include a derrick and a hoisting apparatus for raising and lowering a drill string 30, which, as shown, extends into borehole 40 and includes a bottom hole assembly (BHA) 50. The BHA 50 includes a drill bit 32, a steering tool 60 (also referred to as a directional drilling tool), and one or more downhole navigation sensors 70 such as measurement while drilling sensors including three axis accelerometers and/or three axis magnetometers. The BHA 50 may further include substantially any other suitable downhole tools such as a downhole drilling motor, a downhole telemetry system, a reaming tool, and the like. The disclosed embodiments are not limited with regard to such other tools.

It will be understood that the BHA may include substantially any suitable steering tool 60, for example, including a rotary steerable tool. Various rotary steerable tool configurations are known in the art including various steering mechanisms for controlling the direction of drilling. For example, many existing rotary steerable tools include a substantially non-rotating outer housing employing blades that engage the borehole wall. Engagement of the blades with the borehole wall can be controlled to vary the attitude of the drill bit during drilling, thereby pointing or pushing the drill bit in a desired direction while drilling. A rotating shaft deployed in the outer housing transfers rotary power and axial weight-on-bit to the drill bit during drilling. Accelerometer and magnetometer sets may be deployed in the outer housing and therefore are non-rotating or rotate slowly with respect to the borehole wall.

In one embodiment, the BHA 50 can employ a rotary steerable system (RSS), such as the PowerDrive rotary steerable system available from SLB which fully rotates with the drill string (i.e., the outer housing rotates with the drill string). The PowerDrive Xceed makes use of an internal steering mechanism that will not require contact with the borehole wall and enables the tool body to fully rotate with the drill string. The PowerDrive X5, X6, and PowerDrive Orbit rotary steerable systems make use of mud actuated blades (or pads) that contact the borehole wall. The extension of the blades (or pads) is rapidly and continually adjusted as the system rotates in the borehole. The PowerDrive Archer makes use of a lower steering section joined at an articulated swivel with an upper section. The swivel is actively tilted via pistons so as to change the angle of the lower section with respect to the upper section and maintain a desired drilling direction as the bottom hole assembly rotates in the borehole. Accelerometer and magnetometer sets may rotate with the drill string or may alternatively be deployed in an internal roll-stabilized housing such that they remain substantially stationary (in a bias phase) or rotate slowly with respect to the borehole (in a neutral phase). To drill a desired curvature, the bias phase and neutral phase are alternated during drilling at a predetermined ratio (referred to as the steering ratio). Again, the disclosed embodiments are not limited to use with any particular steering tool configuration.

The downhole sensors 70 may include substantially any suitable sensor arrangement used making downhole navigation measurements (borehole inclination, borehole azimuth, and/or tool face measurements). Such sensors may include, for example, accelerometers, magnetometers, gyroscopes, and the like. Such sensor arrangements are well known in the art and are therefore not described in further detail. The disclosed embodiments are not limited to the use of any particular sensor embodiments or configurations. Methods for making real-time while drilling measurements of the borehole inclination and borehole azimuth are disclosed, for example, in commonly assigned U.S. Pat. Nos. 9,273,547B2 and 9,982,525B2. In the depicted embodiment, the sensors 70 are shown to be deployed in the steering tool 60. Such a depiction is merely for convenience as the sensors 70 may be deployed elsewhere in the BHA.

It will be understood by those of ordinary skill in the art that the deployment illustrated on FIG. 1 is merely an example. It will be further understood that disclosed embodiments are not limited to use with a semisubmersible platform 12 as illustrated on FIG. 1. The disclosed embodiments are equally well suited for use with any kind of subterranean drilling operation, either offshore or onshore.

Figure 2:
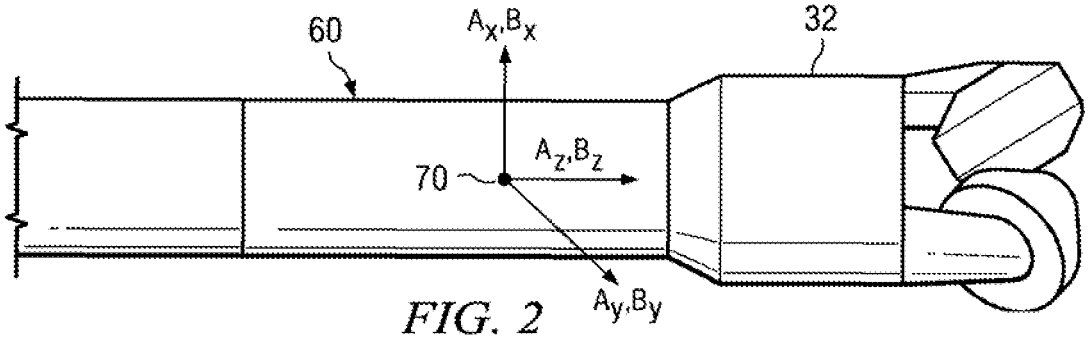
FIG. 2 depicts a lower BHA portion of the drill string shown on FIG. 1.

FIG. 2 depicts the lower BHA portion of drill string 30 including drill bit 32 and steering tool 60. As described above with respect to FIG. 1, the steering tool may include navigation sensors 70 including tri-axial (three axis) accelerometer and magnetometer navigation sensors. Suitable accelerometers and magnetometers may be chosen from among substantially any suitable commercially available devices known in the art. FIG. 2 further includes a diagrammatic representation of the tri-axial accelerometer and magnetometer sensor sets. By tri-axial, it is meant that each sensor set includes three mutually perpendicular sensors, the accelerometers being designated as $A_x$, $A_y$, and $A_z$ and the magnetometers being designated as $B_x$, $B_y$, and $B_z$. By convention, a right handed system is designated in which the z-axis accelerometer and magnetometer ($A_z$ and $B_z$) are oriented substantially parallel with the borehole as indicated (although disclosed embodiments are not limited by such conventions). Each of the accelerometer and magnetometer sets may therefore be considered as determining a plane (the x and y-axes) and a pole (the z-axis along the axis of the BHA).

Figure 3:
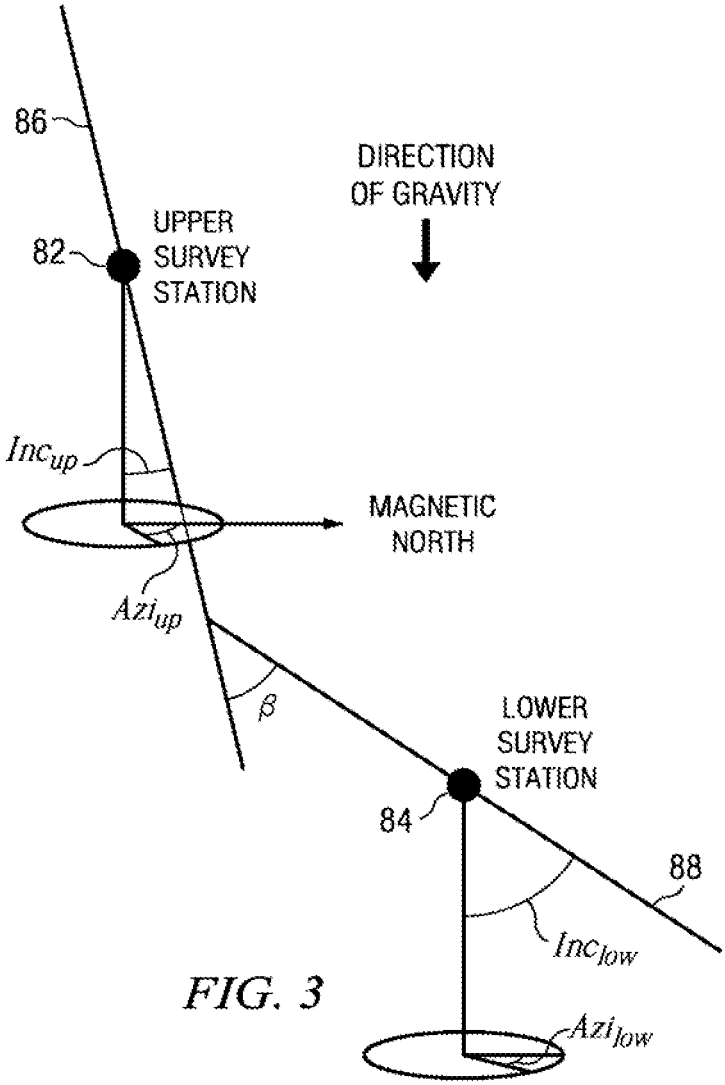
FIG. 3 depicts a diagram of attitude and steering parameters in a global coordinate reference frame.

FIG. 3 depicts a diagram of attitude in a global coordinate reference frame at first and second upper and lower survey stations 82 and 84. The attitude of a BHA defines the orientation of the BHA axis (axis 86 at the upper survey station 82 and axis 88 at the lower survey station 84) in three-dimensional space. In wellbore surveying applications, the wellbore attitude represents the direction of the BHA axis in the global coordinate reference frame (and is commonly understood to be approximately equal to the direction of propagation of the drill bit). Attitude may be represented by a unit vector the direction of which is often defined by the borehole inclination and the borehole azimuth. In FIG. 3 the borehole inclination at the upper and lower survey stations 82 and 84 is represented by $Inc_{up}$ and $Incl_{ow}$ while the borehole azimuth is represented by $Azi_{up}$ and $Azi_{low}$. The angle β represents the overall angle change of the borehole between the first and second survey stations 82 and 84.

Figure 4:
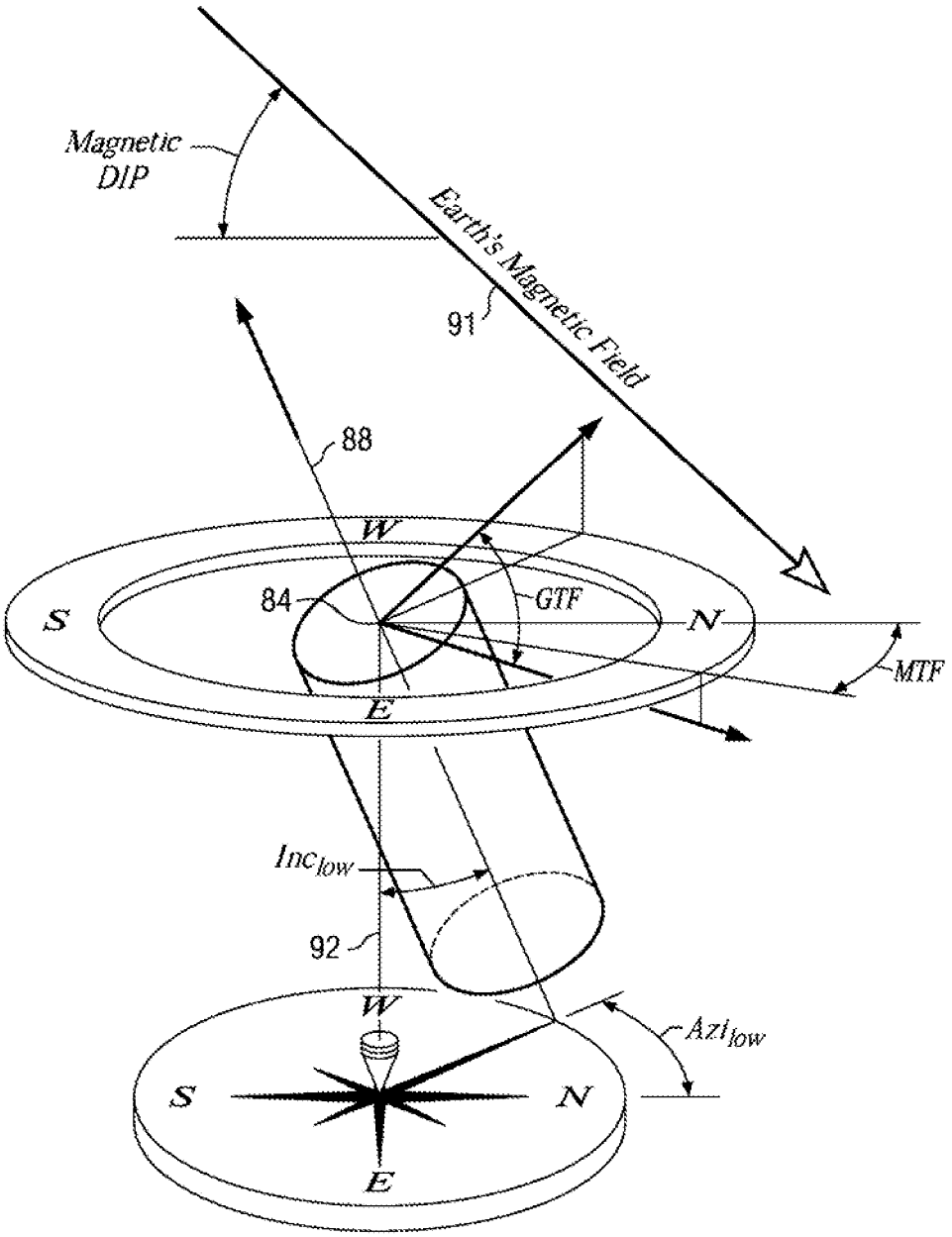
FIG. 4 depicts a diagram of gravity toolface and magnetic toolface in a global reference frame.

FIG. 4 depicts a further diagram of attitude and toolface in a global coordinate reference frame at the second lower survey station 84. The Earth's magnetic field and gravitational field are depicted at 91 and 92. The borehole inclination $Inc_{low}$ represents the deviation of axis 88 from vertical while the borehole azimuth $Azil_{ow}$ represents the deviation of a projection of axis 88 on the horizontal plane from magnetic north. Gravity toolface (GTF) is the angular deviation about the circumference of some component of the downhole tool with respect to the highside (HS) of the tool collar (or borehole). In this disclosure, gravity tool face (GTF) represents the angular deviation between the direction towards which the drill bit is being turned and the highside direction (e.g., in a slide drilling operation, the gravity tool face represents the angular deviation between a bent sub scribe line and the highside direction). Magnetic toolface (MTF) is similar to GTF but uses magnetic north as a reference direction. In particular, MTF is the angular deviation in the horizontal plane between the direction towards which the drill bit is being turned and magnetic north.

It will be understood that the disclosed embodiments are not limited to the above described conventions for defining borehole coordinates depicted in FIGS. 2, 3, and 4. It will be further understood that these conventions can affect the form of certain of the mathematical equations that follow in this disclosure. Those of ordinary skill in the art will be readily able to utilize other conventions and derive equivalent mathematical equations.

In current drilling practices, the trajectory of the build section(s) or curve or bend of a wellbore is controlled by automated drilling methods that use target inclination and target azimuth of the wellbore being drilled together with measurements of both inclination and azimuth of the actual trajectory of the wellbore being drilled in closed loop control of the RSS of the drilling system. The target inclination and target azimuth are determined from programmed GTF downlinked to the RSS. The measurements of inclination and azimuth of the actual trajectory of the wellbore are derived from sensor data obtained from downhole sensors, such as accelerometers, magnetometers, and gyroscopes.

In some instances, noise in the azimuth measurements used in the closed loop control of the RSS while drilling the build section or curve or bend can be high, and this noise can affect performance. For example, jumpy or erratic azimuth measurements used in such closed loop control can result in an erratic toolface (i.e., direction of drilling) or an erratic SR parameter (i.e., time that the RSS will spend in holding the desired toolface), which can result in less efficient drilling, a less smooth well path and in some cases lead the drilling operation to believe that the closed loop control of the RSS is not working.

In a first aspect of the present disclosure, an improved control mode or process is provided for automated control of drilling trajectory during directional drilling. This control mode is referred to as "AutoCurve_IC" herein. In embodiments, the AutoCurve_IC control mode can be activated (manually by instructions from a drilling operator or automatically by instructions from a processor or other programmed controller) when the directional drilling is drilling a build section or curve or bend of a wellborc.

In embodiments, the AutoCurve_IC control mode can be configured to use a target inclination of the wellbore being drilled together with measurements of inclination of the wellbore being drilled in closed loop control of the inclination of the RSS of the drilling system concurrently with open loop control of the azimuth of the RSS of the drilling system. In the open loop control of the azimuth of the RSS of the drilling system, the AutoCurve_IC control mode can be configured to set the azimuth of the RSS of the drilling system based on a target azimuth but will not dynamically adjust the azimuth of the RSS of the drilling system based on measurement of azimuth of the actual trajectory of the wellbore being drilled. The target inclination and target azimuth can be determined from the toolface (e.g., GTF or MTF toolface) downlinked to the RSS. The measurements of inclination of the actual trajectory of the wellbore while drilling can be derived from sensor data obtained from downhole sensors, such as accelerometers, magnetometers, and gyroscopes.

In embodiments, the AutoCurve_IC control mode can be configured as a pre-set when programming the RSS for drilling a wellbore. It can also be configured to be toggled on and off by commands communicated to the RSS (for example, the commands of an MPDL Map). This configuration can be triggered or invoked should the drilling operations temporarily experience erratic azimuth measurements as can be the case entering the blended zone when drilling through North or South.

In embodiments, the AutoCurve_IC control mode can be configured to be triggered or invoked automatically without surface intervention based on evaluation of predefined conditions (such as variations in magnetometer and dip values falling within a set range of values, or size of variations in continuous inclination and azimuth values exceeding a set limit).

In other embodiments, the AutoCurve_IC control mode can be configured to be triggered or invoked automatically upon detection of azimuthal fluctuations or detection of a period of time or prior to landing the wellbore and/or drilling a lateral section of the wellbore.

Figure 5:
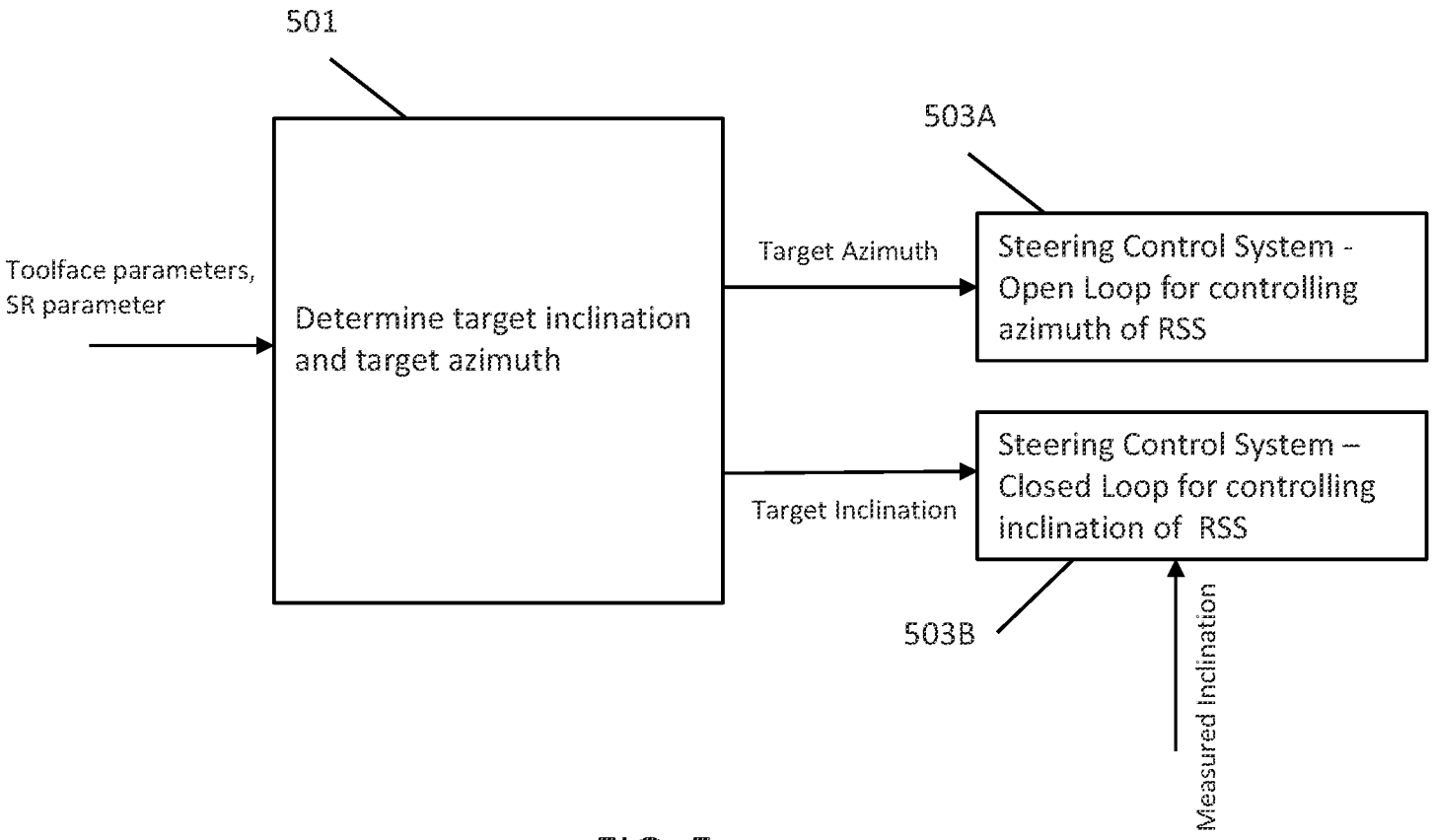
FIG. 5 is a control block diagram that implements an automated control method according to a first aspect of the present disclosure.

FIG. 5 illustrates a control block diagram of the AutoCurve_IC control mode. The inputs to the first block 501 include toolface parameters (such as parameters specifying GTF or MTF for the drilling operation) and optionally an SR parameter that specifies time that the RSS will spend holding the desired toolface. The output of block 501 is the demanded target inclination and target azimuth. The target azimuth is supplied to the steering control system (block 503A), which implements open loop control of the azimuth of the RSS based on the target azimuth. In embodiments, the open loop control of block 503A can be configured to set the azimuth of the RSS based on a target azimuth but will not dynamically adjust the azimuth of the RSS of the drilling system based on measurement of azimuth of the actual trajectory of the wellbore being drilled. The target inclination is supplied to the steering control system (block 503B), which implements closed loop control of the inclination of the RSS based on the target inclination. In embodiments, the closed loop control of block 503B can be configured to use the target inclination and the measured inclination of the toolface during drilling as determined from sensor data to control the direction of drilling such that the measured inclination of the toolface tracks the target inclination. The target inclination and target azimuth can be determined from the toolface downlinked to the RSS. The measurements of azimuth and inclination of the actual trajectory of the wellbore while drilling can be derived from sensor data obtained from downhole sensors, such as accelerometers, magnetometers, and gyroscopes.

In embodiments, the AutoCurve_IC control mode can be repeated with stepwise adjustments to the toolface parameters (such as parameters specifying GTF or MTF) over time during the drilling. Such stepwise adjustments can represent the variable target direction in the build section or curve of bend in the wellbore such that the trajectory of the drilling and the resulting wellbore follows or approximates a planned or otherwise desired curved path.

In a second aspect of the present disclosure, another improved control mode or process is provided for automated control of drilling trajectory during directional drilling. This control mode is referred to as "AutoCurve_MTF" herein. In embodiments, the AutoCurve_MTF control mode can be activated (manually by instructions from a drilling operator or automatically by instructions from a processor or other programmed controller) when the directional drilling is drilling a build section or curve or bend of a wellbore.

In embodiments, the AutoCurve_MTF control mode can be configured to receive toolface parameters representing MTF for drilling a build section or curve or bend of a wellbore. The MTF parameters are used to determine a target inclination and target azimuth of the wellbore while drilling. The target inclination and the target azimuth are used together with measurements of azimuth and inclination of the wellbore being drilled in closed loop control of the azimuth and inclination of the RSS of the drilling system. In the closed loop control, the AutoCurve_MTF control mode can be configured to dynamically adjust both the azimuth and the inclination of the RSS of the drilling system based on measurement of azimuth and inclination of the actual trajectory of the wellbore being drilled. The target inclination and target azimuth can be determined from the MTF toolface downlinked to the RSS. The measurements of azimuth and inclination of the actual trajectory of the wellbore while drilling can be derived from sensor data obtained from downhole sensors, such as accelerometers, magnetometers, and gyroscopes.

In embodiments, the AutoCurve_MTF control mode can be configured as a pre-set when programming the RSS for drilling a wellbore. It can also be configured to be toggled on and off by commands communicated to the RSS (for example, the commands of an MPDL Map).

In embodiments, the AutoCurve_MTF control mode can be configured to be triggered or invoked automatically without surface intervention based on evaluation of predefined conditions.

Note that MTF toolface is currently used in a manual mode to kick off the well and when there is some angle in the well, e.g., around five (5) degrees inclination. The drilling operation normally downlinks to GTF Mode for the rest of the build section or curve or bend.

The AutoCurve_MTF control mode is advantageous for drilling a build section or curve or bend of a wellbore because the curved section can be drilled with less downlinks, which can increase the rate of penetration of the drilling and reduce human errors and reduce the drilling costs for the wellbore.

Figure 6:
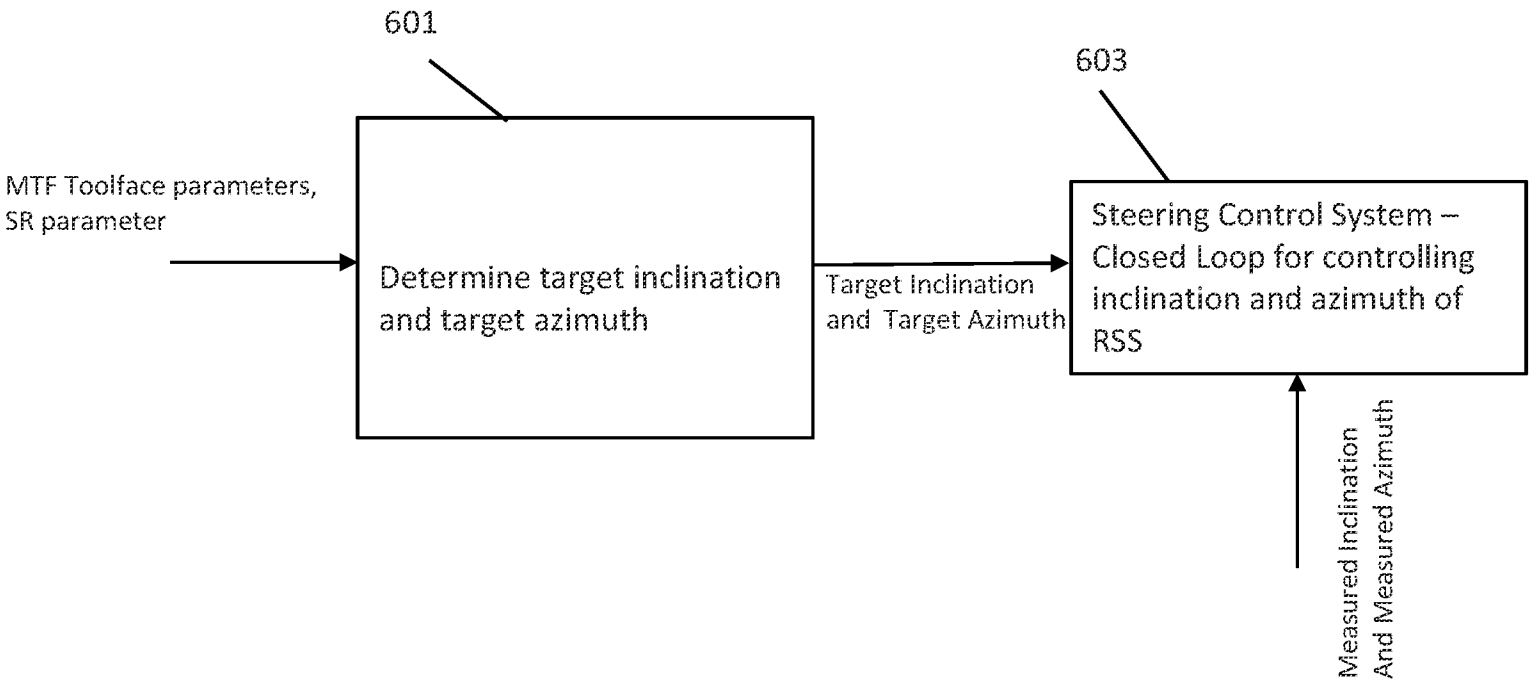
FIG. 6 is a control block diagram that implements an automated control method according to a second aspect of the present disclosure.

FIG. 6 illustrates a control block diagram of the AutoCurve_MTF control mode. The inputs to the first block 601 include MTF toolface parameters (i.e., parameters specifying MTF for the drilling operation) and optionally an SR parameter that specifies time that the RSS will spend in holding the desired toolface. The output of block 601 is the demanded target inclination and target azimuth. The target inclination and the target azimuth are supplied to the steering control system (block 603), which implements closed loop control of the inclination and azimuth of the RSS based on the target inclination and the target azimuth. In embodiments, the closed loop control of block 603 can be configured to dynamically adjust both the azimuth and the inclination of the RSS of the drilling system to control the direction of drilling such that the measured inclination and measured azimuth derived from sensor data tracks the target azimuth and target inclination. The target inclination and target azimuth can be determined from the MTF toolface downlinked to the RSS. The measurements of azimuth and inclination of the actual trajectory of the wellbore while drilling can be derived from sensor data obtained from downhole sensors, such as accelerometers, magnetometers, and gyroscopes.

In embodiments, the AutoCurve_MTF control mode can be repeated with stepwise adjustments to the MTF toolface parameters over time during the drilling. Such stepwise adjustments can represent the variable target direction in the build section or curve of bend in the wellbore such that the trajectory of the drilling and the resulting wellbore follows or approximates a planned or otherwise desired curved path.

The described embodiments herein are configured for downhole implementation via one or more controllers deployed downhole (e.g., in a steering/directional drilling tool). A suitable controller may include, for example, a programmable processor, such as a microprocessor or a microcontroller and processor-readable or computer-readable program code embodying logic. A suitable processor may be utilized, for example, to execute the method embodiments described above. A suitable controller may also optionally include other controllable components, such as sensors (e.g., a depth sensor), data storage devices, power supplies, timers, and the like. The controller may also be disposed to be in electronic communication with the attitude sensors (e.g., to receive the continuous inclination and azimuth measurements). A suitable controller may also optionally communicate with other instruments in the drill string, such as, for example, telemetry systems that communicate with the surface. A suitable controller may further optionally include volatile or non-volatile memory or a data storage device.

The disclosed embodiments may further include a downhole steering tool having a downhole steering tool body, a steering mechanism for controlling a direction of drilling a subterranean wellbore and sensors for measuring attitude (i.e., inclination and azimuth) of the wellbore as it is drilled. The steering tool may further include a downhole controller including one or more modules that embody a cascade closed-loop system that processes parameter data and attitude measurements received from the sensors to control the direction of drilling as described herein.

Figure 7:
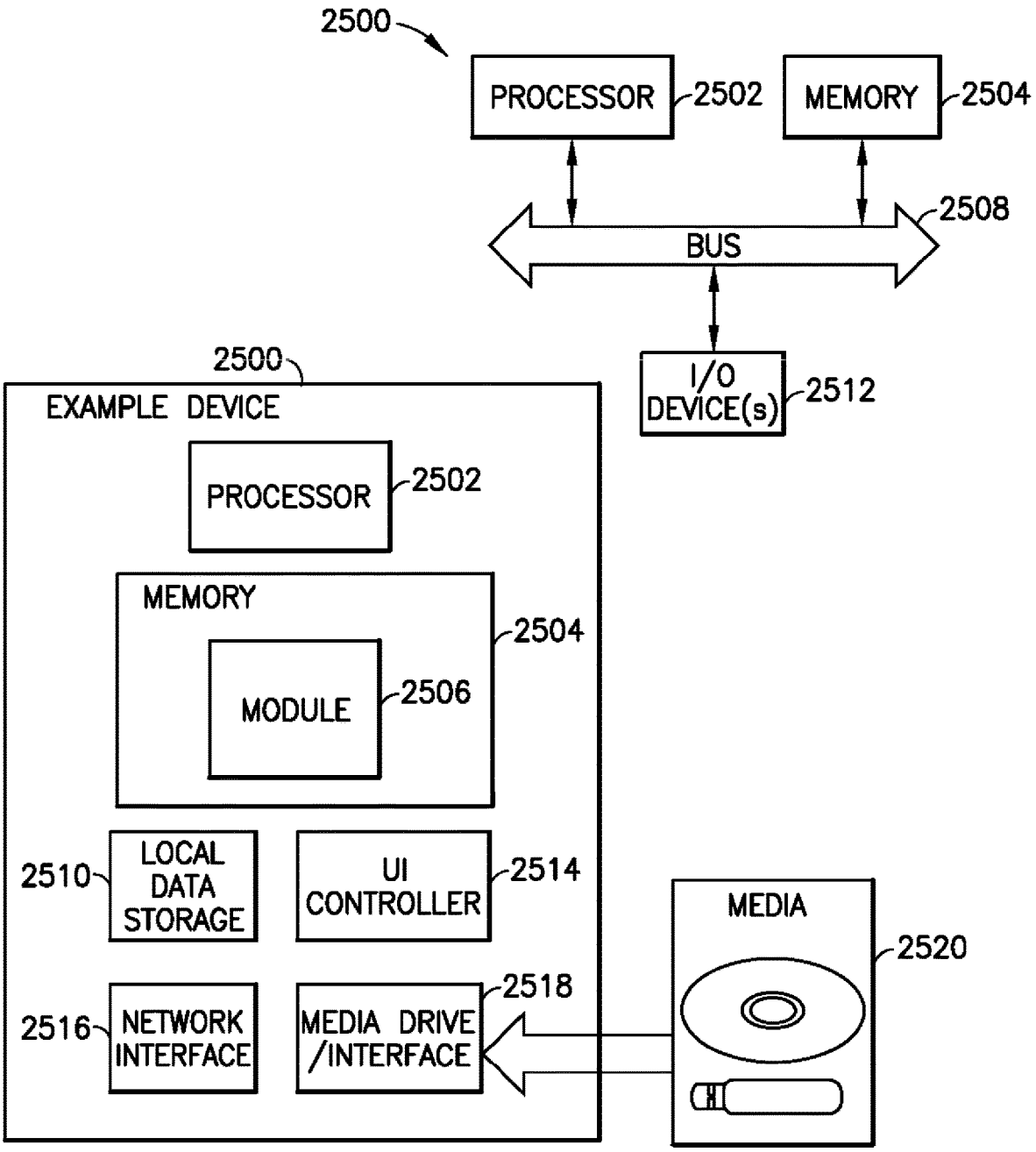
FIG. 7 is a schematic diagram of a computer processing system.

FIG. 7 illustrates an example device 2500, with a processor 2502 and memory 2504 that can be configured to implement various embodiments of the processes and systems as discussed in the present application. For example, various steps or operations of the processes or systems as described herein can be embodied by computer program instructions (software) that execute on device 2500. Memory 2504 can also host one or more databases and can include one or more forms of volatile data storage media such as random-access memory (RAM), and/or one or more forms of nonvolatile storage media (such as read-only memory (ROM), flash memory, and so forth).

Device 2500 is one example of a computing device or programmable device and is not intended to suggest any limitation as to scope of use or functionality of device 2500 and/or its possible architectures. For example, device 2500 can comprise one or more computing devices, programmable logic controllers (PLCs), etc.

Further, device 2500 should not be interpreted as having any dependency relating to one or a combination of components illustrated in device 2500. For example, device 2500 may include one or more of computers, such as a laptop computer, a desktop computer, a mainframe computer, etc., or any combination or accumulation thereof.

Device 2500 can also include a bus 2508 configured to allow various components and devices, such as processors 2502, memory 2504, and local data storage 2510, among other components, to communicate with each other.

Bus 2508 can include one or more of any of several types of bus structures, including a memory bus or memory controller, a peripheral bus, an accelerated graphics port, and a processor or local bus using any of a variety of bus architectures. Bus 2508 can also include wired and/or wireless buses.

Local data storage 2510 can include fixed media (e.g., RAM, ROM, a fixed hard drive, etc.) as well as removable media (e.g., a flash memory drive, a removable hard drive, optical disks, magnetic disks, and so forth). One or more input/output (I/O) device(s) 2512 may also communicate via a user interface (UI) controller 2514, which may connect with I/O device(s) 2512 either directly or through bus 2508.

In one possible implementation, a network interface 2516 may communicate outside of device 2500 via a connected network. A media drive/interface 2518 can accept removable tangible media 2520, such as flash drives, optical disks, removable hard drives, software products, etc. In one possible implementation, logic, computing instructions, and/or software programs comprising elements of module 2506 may reside on removable media 2520 readable by media drive/interface 2518.

In one possible embodiment, input/output device(s) 2512 can allow a user (such as a human annotator) to enter commands and information to device 2500, and also allow information to be presented to the user and/or other components or devices. Examples of input device(s) 2512 include, for example, sensors, a keyboard, a cursor control device (e.g., a mouse), a microphone, a scanner, and any other input devices known in the art. Examples of output devices include a display device (e.g., a monitor or projector), speakers, a printer, a network card, and so on.

Various processes and systems of present disclosure may be described herein in the general context of software or program modules, or the techniques and modules may be implemented in pure computing hardware. Software generally includes routines, programs, objects, components, data structures, and so forth that perform particular tasks or implement particular abstract data types. An implementation of these modules and techniques may be stored on or transmitted across some form of tangible computer-readable media. Computer-readable media can be any available data storage medium or media that is tangible and can be accessed by a computing device. Computer readable media may thus comprise computer storage media. "Computer storage media" designates tangible media, and includes volatile and non-volatile, removable, and non-removable tangible media implemented for storage of information such as computer readable instructions, data structures, program modules, or other data. Computer storage media include, but are not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other tangible medium which can be used to store the desired information, and which can be accessed by a computer.

Some of the methods and processes described above, can be performed by a processor. The term "processor" should not be construed to limit the embodiments disclosed herein to any particular device type or system. The processor may include a computer system. The computer system may also include a computer processor (e.g., a microprocessor, microcontroller, digital signal processor, general-purpose computer, special-purpose machine, virtual machine, software container, or appliance) for executing any of the methods and processes described above.

The computer system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device.

Alternatively or additionally, the processor may include discrete electronic components coupled to a printed circuit board, integrated circuitry (e.g., Application Specific Integrated Circuits (ASIC)), and/or programmable logic devices (e.g., a Field Programmable Gate Arrays (FPGA)). Any of the methods and processes described above can be implemented using such logic devices.

Some of the methods and processes described above can be implemented as computer program logic for use with the computer processor. The computer program logic may be embodied in various forms, including a source code form or a computer executable form. Source code may include a series of computer program instructions in a variety of programming languages (e.g., an object code, an assembly language, or a high-level language such as C, C++, or JAVA). Such computer instructions can be stored in a non-transitory computer readable medium (e.g., memory) and executed by the computer processor. The computer instructions may be distributed in any form as a removable storage medium with accompanying printed or electronic documentation (e.g., shrink wrapped software), preloaded with a computer system (e.g., on system ROM or fixed disk), or distributed from a server over a communication network (e.g., the Internet).

Although only a few example embodiments have been described in detail above, those skilled in the art will readily appreciate that many modifications are possible in the example embodiments without materially departing from this invention.

Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

The invention claimed is:

1. A method of operations for automated closed-loop control of drilling trajectory during directional drilling performed by a drilling system that employs a rotary steerable system (RSS), the method comprising:

while drilling a build section or bend or curve of a wellbore, determining target inclination and target azimuth of the RSS, wherein the target inclination is set using closed loop control and the target azimuth is set using open loop control;

using the target inclination together with measurements of inclination of the wellbore being drilled in the closed loop control of the inclination of the RSS while drilling the build section or bend or curve of the wellbore; and concurrently with the closed loop control of the inclination of the RSS, using the target azimuth for the open loop control of the azimuth of the RSS while drilling the build section or bend or curve of the wellbore, wherein the open loop control is automatically invoked in response to detection of azimuthal fluctuations, detection of a period of time, prior to landing the wellbore, prior to drilling a lateral section of the wellbore, or any combination thereof.

2. A method according to claim 1, wherein:

the open loop control of the azimuth of the RSS while drilling the build section or bend or curve of the wellbore will not dynamically adjust the azimuth of the RSS based on measurement of azimuth of the actual trajectory of the wellbore being drilled.

3. A method according to claim 1, wherein:

the target inclination and target azimuth are determined from toolface parameters downlinked or received while drilling the build section or bend or curve of the wellbore.

4. A method according to claim 3, wherein:

the toolface parameters specify a gravity toolface (GTF) for drilling the build section or bend or curve of the wellbore, or the toolface parameters specify a magnetic toolface (MTF) for drilling the build section or bend or curve of the wellbore.

5. A method according to claim 3, further comprising:

repeating the operations of the method with stepwise adjustments to the toolface parameters over time during the drilling, wherein the stepwise adjustments represent variable target direction in the build section or curve of bend in the wellbore such that the trajectory of the drilling and the resulting wellbore follows or approximates a planned or otherwise desired curved path.

6. A control system for automated control of drilling trajectory during directional drilling performed by a drilling system that employs a rotary steerable system (RSS), the control system comprising:

at least one module configured to perform the method of claim 1 to control the RSS while drilling a build section or curve of bend in a wellbore.

7. A control system according to claim 6, wherein:

the at least one module is embodied by a downhole processor or controller.

8. A directional drilling system comprising:

a bottomhole assembly that includes a rotary steerable system (RSS) and a drill bit; and at least one module configured to perform the method of claim 1 to control the RSS while drilling a build section or curve of bend in a wellbore.

9. A directional drilling system according to claim 8, wherein:

the at least one module is embodied by a downhole processor or controller.

10. A method of operations for automated closed-loop control of drilling trajectory during directional drilling performed by a drilling system that employs a rotary steerable system (RSS), the method comprising:

receiving toolface parameters representing magnetic tool face (MTF) for drilling a build section or curve or bend of a wellbore;

using the toolface parameters representing MTF to determine a target inclination and target azimuth of the wellbore while drilling the build section or curve or bend of the wellbore;

using the target inclination and the target azimuth together with measurements of conditions associated with azimuth and inclination of the wellbore being drilled in closed loop control of the azimuth and inclination of the RSS while drilling the build section or bend or curve of the wellbore, wherein the closed loop control is configured to be triggered or invoked automatically without surface intervention in response to an evaluation of predefined conditions; and repeating the operations with stepwise adjustments to the toolface parameters representing MTF over time during the drilling, wherein the stepwise adjustments represent a variable target direction in the build section or curve of bend in the wellbore such that the drilling trajectory of the drilling and the resulting wellbore follows or approximates a planned or otherwise desired curved path.

11. A method according to claim 10, wherein:

the closed loop control of the azimuth and the inclination of the RSS while drilling the build section or bend or curve of the wellbore dynamically adjusts the azimuth and the inclination of the RSS based on corresponding measurements of azimuth and inclination of the actual trajectory of the wellbore being drilled.

12. A method according to claim 10, wherein:

the toolface parameters representing MTF are received or downlinked while drilling the build section or bend or curve of the wellbore.

13. A control system for automated control of drilling trajectory during directional drilling performed by a drilling system that employs a rotary steerable system (RSS), the control system comprising:

at least one module configured to perform the method of claim 10 to control the RSS while drilling a build section or curve of bend in a wellbore.

14. A control system of according to claim 13, wherein:

the at least one module is embodied by a downhole processor or controller.

15. A directional drilling system comprising:

a bottomhole assembly that includes a rotary steerable system (RSS) and a drill bit; and at least one module configured to perform the method of claim 10 to control the RSS while drilling a build section or curve of bend in a wellbore.

16. A directional drilling system according to claim 15, wherein:

the at least one module is embodied by a downhole processor or controller.

17. A method according to claim 10, wherein the closed loop control dynamically adjusts both the azimuth and the inclination of the RSS.

18. A method according to claim 1, wherein the open loop control is automatically invoked in response to the detection of azimuthal fluctuations.

19. A method according to claim 1, wherein the open loop control is automatically invoked in response to the detection of the period of time.

20. A method according to claim 1, wherein the open loop control is automatically invoked prior to landing the wellbore, or prior to drilling the lateral section of the wellbore, or both.

* * * * *